US010564571B2

(12) United States Patent
Suzuki et al.

(10) Patent No.: US 10,564,571 B2
(45) Date of Patent: Feb. 18, 2020

(54) TONER SET, IMAGE FORMING APPARATUS, AND IMAGE FORMING METHOD

(71) Applicants: Kazumi Suzuki, Shizuoka (JP); Toyoshi Sawada, Shizuoka (JP); Yu Naito, Shizuoka (JP); Natsuko Matsushita, Shizuoka (JP)

(72) Inventors: Kazumi Suzuki, Shizuoka (JP); Toyoshi Sawada, Shizuoka (JP); Yu Naito, Shizuoka (JP); Natsuko Matsushita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/133,825

(22) Filed: Sep. 18, 2018

(65) Prior Publication Data

US 2019/0086834 A1 Mar. 21, 2019

(30) Foreign Application Priority Data

Sep. 19, 2017 (JP) ..... 2017-178771

(51) Int. Cl.
*G03G 15/08* (2006.01)
*G03G 15/06* (2006.01)
(Continued)

(52) U.S. Cl.
CPC ..... *G03G 15/0865* (2013.01); *G03G 9/087* (2013.01); *G03G 15/16* (2013.01); *G03G 15/2064* (2013.01)

(58) Field of Classification Search
CPC .. G03G 15/0865; G03G 9/0821; G03G 9/091; G03G 9/0906; G03G 9/0904;
(Continued)

(56) References Cited

U.S. PATENT DOCUMENTS

2012/0156604 A1 6/2012 Fukatsu et al.
2014/0272339 A1* 9/2014 Tyagi ..... G03G 9/0926 428/207

(Continued)

FOREIGN PATENT DOCUMENTS

EP 2 166 414 A1 3/2010
JP 9-073223 3/1997

(Continued)

OTHER PUBLICATIONS

U.S. Appl. No. 15/879,495, filed Jan. 25, 2018, Namie Suzuki, et al.

(Continued)

*Primary Examiner* — Thorl Chea
(74) *Attorney, Agent, or Firm* — Oblon, McClelland, Maier & Neustadt, L.L.P.

(57) ABSTRACT

A toner set for use in an image forming apparatus is provided. The toner set includes a fluorescent toner and a color toner. The fluorescent toner comprises a binder resin and a fluorescent agent. The color toner comprises a binder resin and a colorant. A 60-degree gloss value (Gf) of a solid image of the fluorescent toner is in a range of from 10 to 25, and a difference (Gn−Gf) between a 60-degree gloss value (Gn) of a solid image of the color toner and the 60-degree gloss value (Gf) of the solid image of the fluorescent toner is in a range of from 10 to 28.

10 Claims, 4 Drawing Sheets

(51) Int. Cl.

| | |
|---|---|
| ***G03G 15/20*** | (2006.01) |
| ***G03G 9/087*** | (2006.01) |
| ***G03G 9/08*** | (2006.01) |
| ***G03G 9/09*** | (2006.01) |
| ***G03G 15/16*** | (2006.01) |

(58) Field of Classification Search
CPC .. G03G 9/0926; G03G 9/087; G03G 15/2064; G03G 15/16
See application file for complete search history.

(56) References Cited

U.S. PATENT DOCUMENTS

| | | | | |
|---|---|---|---|---|
| 2015/0030819 | A1 | 1/2015 | Naito et al. | |
| 2015/0037718 | A1 | 2/2015 | Morita et al. | |
| 2015/0072287 | A1 | 3/2015 | Amemori et al. | |
| 2015/0153671 | A1 | 6/2015 | Yamauchi et al. | |
| 2015/0212442 | A1 | 7/2015 | Ishii et al. | |
| 2015/0212444 | A1 | 7/2015 | Yamauchi et al. | |
| 2015/0220011 | A1 | 8/2015 | Miyaake et al. | |
| 2015/0227066 | A1 | 8/2015 | Sugiura et al. | |
| 2015/0248073 | A1 | 9/2015 | Nakayama et al. | |
| 2015/0248074 | A1* | 9/2015 | Suzuki ..... | G03G 9/0821 430/105 |
| 2015/0253685 | A1 | 9/2015 | Suzuki et al. | |
| 2015/0253688 | A1 | 9/2015 | Yamauchi et al. | |
| 2016/0091812 | A1 | 3/2016 | Makabe et al. | |
| 2016/0223926 | A1 | 8/2016 | Miyaake et al. | |
| 2016/0327884 | A1 | 11/2016 | Nakajima et al. | |
| 2017/0139337 | A1 | 5/2017 | Kaneko et al. | |
| 2018/0067409 | A1 | 3/2018 | Yamauchi et al. | |
| 2018/0113391 | A1 | 4/2018 | Yamauchi et al. | |

FOREIGN PATENT DOCUMENTS

| | | |
|---|---|---|
| JP | 2003-107803 | 4/2003 |
| JP | 2005-120367 | 5/2005 |
| JP | 2007-171508 | 7/2007 |
| JP | 2007-199178 | 8/2007 |
| JP | 2010-113368 | 5/2010 |
| JP | 2012-215810 | 11/2012 |

OTHER PUBLICATIONS

U.S. Appl. No. 15/911,285, filed Mar. 5, 2018, Kohtaroh Ogino, et al.

U.S. Appl. No. 15/536,531, filed Nov. 26, 2015, Natsuko Matsushita, et al.

Extended European Search Report dated Dec. 10, 2018 in Patent Application No. 18190572.0, 9 pages.

* cited by examiner

TONER SET, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2017-178771, filed on Sep. 19, 2017, in the Japan Patent Office, the entire disclosure of which is hereby incorporated by reference herein.

BACKGROUND

Technical Field

The present disclosure relates to a toner set, an image forming apparatus, and an image forming method.

Description of the Related Art

As electrophotographic color image forming apparatuses have become widespread in recent years, their use has also expanded in various ways and demands for their image quality are getting stricter. Particularly in the fields of design, advertisement, etc., needs for colors which are not able to be reproduced with conventional three-color process colors are increasing. Specifically, needs for fluorescent colors such as fluorescent pink are increasing.

SUMMARY

In accordance with some embodiments of the present invention, a toner set for use in an image forming apparatus is provided. The toner set includes a fluorescent toner and a color toner. The fluorescent toner comprises a binder resin and a fluorescent agent. The color toner comprises a binder resin and a colorant. A 60-degree gloss value (GO of a solid image of the fluorescent toner is in a range of from 10 to 25, and a difference (Gn−Gf) between a 60-degree gloss value (Gn) of a solid image of the color toner and the 60-degree gloss value (GO of the solid image of the fluorescent toner is in a range of from 10 to 28.

In accordance with some embodiments of the present invention, an image forming apparatus is provided. The image forming apparatus includes: an electrostatic latent image bearer; an electrostatic latent image forming device configured to form an electrostatic latent image on the electrostatic latent image bearer; a developing device containing the above-described toner set, configured to develop the electrostatic latent image into a visible image with the toner set; a transfer device configured to transfer the visible image onto a recording medium; and a fixing device configured to fix the transferred image on the recording medium.

In accordance with some embodiments of the present invention, an image forming method is provided. The image forming method includes the processes of: forming an electrostatic latent image on an electrostatic latent image bearer; developing the electrostatic latent image into a visible image with the above-described toner set; transferring the visible image onto a recording medium; and fixing the transferred image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
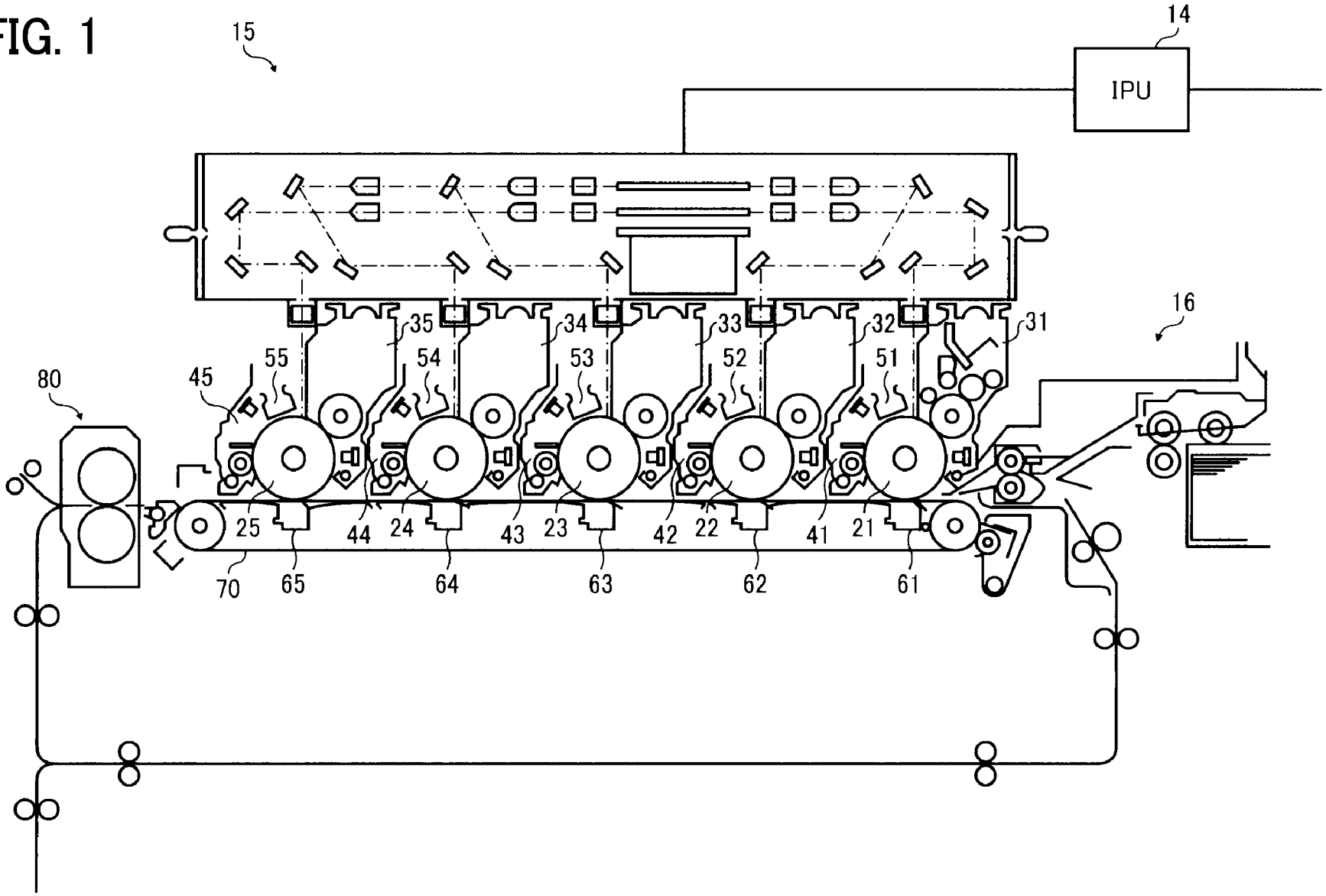
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner set is provided which makes it possible to demonstrate eye-catching designs with fluorescent colors.

In the present disclosure, eye-catching designs may also be referred to as "designs with eye attractiveness".

Toner Set

The toner set according to an embodiment of the present invention is used in an image forming apparatus.

The toner set includes at least one fluorescent toner and at least one color toner.

The fluorescent toner contains a binder resin and a fluorescent agent, and further contains other components as necessary.

The color toner contains a binder resin and a colorant, and further contains other components as necessary.

The toner set according to an embodiment of the present invention provides a design with high fluorescent color visibility and high eye attractiveness by providing a color toner image together with a fluorescent toner image on a surface of a medium for image output. The toner set according to an embodiment of the present invention includes the fluorescent toner and the color toner, as described above, and a 60-degree gloss value (Gf) of a solid image of the fluorescent toner is in a range of from 10 to 25 and a difference (Gn−Gf) between a 60-degree gloss value (Gn) of a solid image of the color toner and the 60-degree gloss value (Gf) of a solid image of the fluorescent toner is in a range of from 10 to 28.

Highly glossy fluorescent toners have been proposed so far. Highly glossy fluorescent toners exert their effect under an environment with a low illuminance. However, particularly in an environment with a high illuminance, the fluorescence intensity relatively decreases due to the occurrence of specular reflection and therefore vivid fluorescence cannot be expressed undesirably.

As a result of studies by the inventors of the present invention, it has been found that vivid fluorescence can be expressed when the relationship in gloss value between the fluorescent toner and the color toner is adjusted to a certain condition.

Fluorescent Toner

The fluorescent toner contains a binder resin and a fluorescent agent, and further contains other components as necessary.

Binder Resin

The binder resin is not particularly limited, and any of conventionally known resins can be used. Examples of the binder resin include, but are not limited to, styrene-based resins such as styrene, α-methylstyrene, chlorostyrene, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, and styrene-acrylonitrile-acrylate copolymer, polyester resins, vinyl chloride resins, rosin-modified maleic acid resins, phenol resins, epoxy resins, polyethylene resins, polypropylene resins, ionomer resins, polyurethane resins, silicone resins, ketone resins, xylene resins, petroleum resins, and hydrogenated petroleum resins. Each of these materials can be used alone or in combination with others. Among these materials, styrene-based resins containing aromatic compounds as constitutional units and polyester resin are preferable, and polyester resins are more preferable.

The polyester resin may be obtained by a polycondensation reaction between commonly known alcohols and acids.

Specific examples of the alcohols include, but are not limited to: diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and polyoxypropylenated bisphenol A; divalent alcohol monomers obtained by substituting the above compounds with a saturated or unsaturated hydrocarbon group having 3 to 22 carbon atoms; other divalent alcohol monomers; and alcohol monomers having 3 or higher valences such as sorbitol, 1,2,3,6-hexanetetraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Each of these materials can be used alone or in combination with others.

The acids are not particularly limited and may be appropriately selected according to the purpose, but carboxylic acids are preferable.

Specific examples of the carboxylic acids include, but are not limited to: monocarboxylic acids such as palmitic acid, stearic acid, and oleic acid; maleic acid, fumaric acid, mesaconic acid, citraconic acid, terephthalic acid, cyclohexanedicarboxylic acid, succinic acid, adipic acid, sebacic acid, and malonic acid, and divalent organic acid monomers obtained by substituting these acids with a saturated or unsaturated hydrocarbon group having 3 to 22 carbon atoms; anhydrides of these acids; dimers of lower alkyl esters and linolenic acid; 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and enpol trimer acid; and polyvalent carboxylic acid monomers having 3 or more valences such as anhydrides of the above acids. Each of these materials can be used alone or in combination with others.

The binder resin may contain a crystalline resin.

The crystalline resin is not particularly limited as long as it has crystallinity and can be appropriately selected according to the purpose. Examples of the crystalline resin include, but are not limited to, polyester resins, polyurethane resins, polyurea resins, polyamide resins, polyether resins, vinyl resins, and modified crystalline resins. Each of these materials can be used alone or in combination with others. Among these materials, polyester resins, polyurethane resins, polyurea resins, polyamide resins, and polyether resins are preferable. In particular, resins having at least one of a urethane backbone and a urea backbone are preferable for imparting moisture resistance and incompatibility with an amorphous resin (to be described later).

It is also preferable that the binder resin contains a gel. The gel fraction in the binder resin is preferably in the range of from 0.5% to 10% by mass, more preferably from 1.0% to 5% by mass.

When an appropriate amount of gel is contained in the binder resin, the gloss value can be reduced while maintaining the ratio of low molecular weight components needed for low temperature fixability. When the amount of gel is within the above-described range, the gloss value of the fluorescent toner image is prevented from decreasing, thus preventing an increase of the amount of diffuse reflection components and insufficient chroma.

The gel fraction can be calculated from the dry weight of the component filtered by a pretreatment filter which was used in the measurement of weight average molecular weight (to be described later).

The crystalline resin preferably has a weight average molecular weight (Mw) of from 2,000 to 100,000, more preferably from 5,000 to 60,000, and most preferably from 8,000 to 30,000, for fixability. When the weight average molecular weight is 2,000 or more, deterioration of offset resistance can be prevented. When the weight average molecular weight is 100,000 or less, deterioration of low temperature fixability can be prevented.

Fluorescent Agent

The fluorescent agent is not particularly limited and may be appropriately selected according to the purpose. Examples thereof include, but are not limited to, fluorescent coloring materials and fluorescent colorants.

Examples of the fluorescent coloring materials include, but are not limited to, Pigment Yellow 101, Solvent Yellow 44, Solvent Orange 5 and 55, Solvent Red 49, 149, and 150, Solvent Blue 5, Solvent Green 7, Acid Yellow 3 and 7, Acid Red 52, 77, 87, and 92, Acid Blue 9, Basic Yellow 1 and 40, Basic Red 1 and 13, Basic Violet 7, 10, and 110, Basic Orange 14 and 22, Basic Blue 7, Basic Green 1, Vat Red 41, Disperse Yellow 82, 121, 124, 184:1, 186, 199, and 216, Disperse Orange 11, Disperse Red 58, 239, 240, 345, 362, and 364, Disperse Blue 7, 56, 183, 155, 354, and 365, Disperse Violet 26, 27, 28, 35, 38, 46, 48, 57, 63, 77, and 97, Direct Yellow 85, Direct Orange 8 and 9, Direct Blue 22, Direct Green 6, Fluorescent Brightening Agent 54, Fluorescent Brightening Agent 135, Fluorescent Brightening Agent 162, and Fluorescent Brightening Agent 260.

Examples of the fluorescent colorants include, but are not limited to, diaminostilbene, fluorescein, thioflavin, Eosin, Rhodamine B, coumarin derivatives, and imidazole derivatives. These fluorescent colorants are of dye type or pigment type, each of which can be used.

Fluorescent dyes may be blended with a melamine resin or the like to be pigmented for safety reason, however, generation of formaldehyde is a concern. Therefore, preferably, fluorescent dyes are blend with an acrylic resin or an olefin resin.

Examples of pigmented fluorescent dyes include, but are not limited to, SX-100 series and SX-1000 series manufactured by SINLOIHI CO., LTD. Specifically, SX-100 series include, but are not limited to, SX-101 Red Orange, SX-103 Red, SX-104 Orange, SX-105 Lemon Yellow, SX-106 Orange Yellow, SX-117 Pink, SX-127 Rose, SX-137 Rubine, SX-147 Violet, and SX-157 Blue Violet. SX-1000 series include, but are not limited to, SX-1004 Orange, SX-1005 Lemon Yellow, SX-1007 Pink, and SX-1037 Magenta.

Usable fluorescent pigments include ordinary daylight fluorescent pigments and inorganic fluorescent pigments. Inorganic fluorescent pigments have phosphorescence as observed in luminescent paints.

Other Components

The other components are not particularly limited as long as they are contained in the toner and can be appropriately selected according to the purpose. Examples thereof include, but are not limited to, a release agent, a charge controlling agent, and an external additive.

Release Agent

Examples of the release agent include, but are not limited to, natural waxes and synthetic waxes. Each of these waxes can be used alone or in combination with others.

Specific examples of the natural waxes include, but are not limited to: plant waxes such as carnauba wax, cotton wax, sumac wax, and rice wax; animal waxes such as bees wax and lanolin; mineral waxes such as ozokerite and ceresin; and petroleum waxes such as paraffin wax, microcrystalline wax, and petrolatum wax.

Specific examples of the synthetic waxes include, but are not limited to: synthetic hydrocarbon waxes such as Fischer-Tropsch wax and polyethylene wax; synthetic waxes such as esters, ketones, and ethers; fatty acid amides such as 1,2-hydroxystearic acid amide, stearic acid amide, phthalic anhydride imide, and chlorinated hydrocarbons; and crystalline polymers, such as homopolymers and copolymers of polyacrylates such as n-stearyl polymethacrylate and n-lauryl polymethacrylate (e.g., n-stearyl acrylate-ethyl methacrylate copolymer), which are low-molecular-weight crystalline polymers, having a long-chain alkyl group on its side chain.

Preferably, the release agent comprises a monoester wax. Since the monoester wax has low compatibility with general binder resins, the monoester wax easily exudes out to the surface of the toner when the toner is fixed. Thus, the toner exhibits high releasability while securing high gloss and sufficient low-temperature fixability.

Preferably, the monoester wax is of a synthetic ester wax. Examples of the synthetic ester wax include, but are not limited to, a monoester wax synthesized from a long-chain linear saturated fatty acid and a long-chain linear saturated alcohol. The long-chain linear saturated fatty acid is represented by the general formula $C_nH_{2n+1}COOH$, and one having n of about 5 to 28 is preferably used. The long-chain linear saturated alcohol is represented by the general formula $C_nH_{2n+1}OH$, and n is preferably about 5 to 28.

Specific examples of the long-chain linear saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, behenic acid, lignoceric acid, cerotic acid, heptacosanoic acid, montanic acid, and melissic acid.

Specific examples of the long-chain linear saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, all of which may have a substituent such as a lower alkyl group, amino group, and halogen.

Preferably, the release agent has a melting point of from 50° C. to 120° C. When the melting point of the release agent is in the above numerical range, the release agent can effectively act at the interface between a fixing roller and the toner, thereby improving high-temperature offset resistance of the toner without applying another release agent such as an oil to the fixing roller. Specifically, when the melting point is 50° C. or higher, deterioration of heat-resistant storage stability of the toner can be prevented. When the melting point is 120° C. or less, deterioration of cold offset resistance and paper winding on the fixing device, which may be caused when releasability is not developed at low temperatures, can be prevented.

The melting point of the release agent can be determined from the maximum endothermic peak measured by a differential scanning calorimeter TG-DSC system TAS-100 (manufactured by Rigaku Corporation).

The content of the release agent in the binder resin is preferably from 1% to 20% by mass, more preferably from 3% to 10% by mass. When the content is 1% by mass or more, deterioration of the offset preventing effect can be prevented. When the content is 20% by mass or less, deterioration of transferability and durability can be prevented.

The content of the monoester wax is preferably from 4 to 8 parts by mass, more preferably 5 to 7 parts by mass, based on 100 parts by mass of the fluorescent toner. When the content is 4 parts by mass or more, exudation to the surface of the toner at the time of fixing will not become insufficient and deterioration of releasability, gloss value, low-temperature fixability, and high-temperature offset resistance can be prevented. When the content is 8 parts by mass or less, deterioration of storage stability and filming property of the toner, which may be caused when the amount of release agent deposited on the surface of the toner is increased, can be prevented.

The toner according to an embodiment of the present invention preferably contains a wax dispersing agent. Preferably, the wax dispersing agent is a copolymer composition containing at least styrene, butyl acrylate, and acrylonitrile as monomers, or a polyethylene adduct of the copolymer composition.

The content of the wax dispersing agent is preferably 7 parts by mass or less based on 100 parts by mass of the fluorescent toner. The wax dispersing agent has an effect of dispersing the wax in the toner, so that storage stability of the toner is reliably improved regardless of production method of the toner. In addition, the diameter of the wax is reduced due to the effect of the wax dispersing agent, so that the toner is suppressed from filming on a photoconductor, etc. When the content is 7 parts by mass or less, various undesirable phenomena can be prevented. For example, gloss decrease caused due to an increase of the amount of polyester-incompatible components is prevented. Also, a decrease of low-temperature fixability and hot offset resistance caused due to insufficient exudation of the wax to the surface of the toner at the time of fixing is prevented, because excessive increase of dispersibility of the wax is prevented although filming resistance is improved.

Charge Controlling Agent

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, fluorine activators, metal salts of salicylic acid, and metal salts of salicylic acid derivatives. Each of these materials can be used alone or in combination with others.

These charge control agents are available either synthetically or commercially. Specific examples of commercially available products include, but are not limited to: BONTRON 03, BONTRON P-51, BONTRON S-34, E-82, E-84, and E-89 (all manufactured by Orient Chemical Industries Co., Ltd.); TP-302, TP-415, COPY CHARGE PSY VP2038, COPY BLUE PR, COPY CHARGE NEG VP2036, AND COPY CHARGE NX VP434 (all manufactured by Hoechst AG); and LRA-901 and LR-147 (all manufactured by Japan Carlit Co., Ltd.).

The content of the charge controlling agent can be appropriately determined depending on the type of the binder resin, the presence or absence of an optional additive, and/or the toner production method including dispersing method, but is preferably from 0.1 to 5 parts by mass, more preferably from 0.2 to 2 parts by mass, based on 100 parts by mass of the binder resin. When the content is 5 parts by mass or less, deterioration of developer fluidity and/or image density can be prevented because the charge of the toner is not so large that the effect of the charge control agent is not reduced and the electrostatic force between the toner and the developing roller is not increased.

Among the above charge controlling agents, metal salts having 3 or more valences are capable of controlling thermal properties of the toner. By containing such a metal salt in the toner, a cross-linking reaction with an acidic group of the binder resin proceeds at the time of fixing to form a weak three-dimensional cross-linkage, whereby high temperature offset resistance is achieved while low-temperature fixability is maintained.

Examples of the metal salt include, but are not limited to, a metal salt of a salicylic acid derivative and a metal salt of acetylacetonate. The metal is not particularly limited as long as it is a polyvalent ionic metal having 3 or more valences, and can be appropriately selected according to the purpose. Examples thereof include iron, zirconium, aluminum, titanium, and nickel. Among them, metal compounds of salicylic acid having 3 or more valences are preferred.

Preferably, the content of the metal salt is in the range of from 0.5 to 2 parts by mass, more preferably from 0.5 to 1 parts by mass, based on 100 parts by mass of the fluorescent toner. When the content is 0.5 parts by mass or more, deterioration of offset resistance can be prevented. When the content is 2 parts by mass or less, deterioration of gloss value can be prevented.

External Additive

The external additive may be contained in the toner to assist fluidity, developability, and chargeability of the toner. The external additive is not particularly limited and may be appropriately selected according to the purpose. Examples of the external additive include, but are not limited to, fine inorganic particles and fine polymeric particles.

Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Each of these materials can be used alone or in combination with others.

Specific examples of the fine polymeric particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles.

The external additive may be surface-treated with a surface treatment agent to improve its hydrophobicity to prevent deterioration of fluidity and chargeability of the toner even under high-humidity conditions.

Specific examples of the surface treatment agent include, but are not limited to, silane coupling agents, silylation agents, silane coupling agents having a fluorinated alkyl group, organic titanate coupling agents, aluminum coupling agents, silicone oils, and modified silicone oils.

The external additive preferably has a primary particle diameter of from 5 nm to 2 μm, and more preferably from 5 nm to 500 μm. The external additive preferably has a specific surface area according to the BET method in the range of from 20 to 500 $m^2/g$.

Preferably, the content rate of the external additive in the toner is from 0.01% to 5% by mass, more preferably from 0.01% to 2.0% by mass.

Cleanability Improving Agent

The cleanability improving agent may be contained in the toner to remove residual developer remaining on a photoconductor or primary transfer medium after image transfer. Specific examples of the cleanability improving agent include, but are not limited to: metal salts of fatty acids, such as zinc stearate and calcium stearate; and fine particles of polymers prepared by soap-free emulsion polymerization etc., such as fine polymethyl methacrylate particles and fine polystyrene particles. Preferably, the particle size distribution of the fine polymer particles is relatively narrow and the volume average particle diameter thereof is in the range of from 0.01 to 1 μm.

Color Toner

The color toner contains a binder resin and a colorant, and further contains other components as necessary. Examples of the other components include the same components exemplified above.

Preferably, the color toner has no fluorescence. Here, whether a toner has fluorescence or not is determined according to the following procedure.

The L value of a solid image of the toner is measured under M0 condition (with no filter) and M2 condition (with UV cut filter) by an instrument X-RITE EXACT (from X-Rite Inc.). When a difference (ΔL) under the whole visible light region between the M0 and M2 conditions is less than 2, it is determined that a toner has no fluorescence. It is determined that a toner has fluorescence when the toner has a wavelength region in which ΔL is 2 or more in the visible light wavelength region.

Preferably, the color toner comprises any one of a cyan toner, a magenta toner, a yellow toner, and a black toner. More preferably, the color toner comprises a cyan toner, a magenta toner, a yellow toner, and a black toner.

In other words, in the toner set, preferably, the 60-degree gloss value of the solid image of the fluorescent toner is lower than the 60-degree gloss value of the solid image of any one of the cyan toner, magenta toner, yellow toner, and black toner by 10 degrees or more. More preferably, the 60-degree gloss value of the solid image of the fluorescent toner is lower than the 60-degree gloss value of all the solid images of the cyan toner, magenta toner, yellow toner, and black toner by 10 degrees or more.

Binder Resin

A toner image formed by the color toner according to an embodiment of the present invention preferably has a gloss value equivalent to that of general offset printed matter. Therefore, the binder resin contained in the color toner is not particularly limited and can be appropriately selected according to the purpose.

Preferably, the weight average molecular weight Mwn of the binder resin of the color toner is smaller than the weight average molecular weight Mwf of the binder resin of the fluorescent toner. When the weight average molecular weight Mwn of the binder resin of the color toner is smaller than the weight average molecular weight Mwf of the binder resin of the fluorescent toner, the resulting color image has a 60-degree gloss value of about 20 to 50 that is equivalent to that of offset printed matter.

The color toner needs not necessarily contain gel. However, when the color toner contains an appropriate amount of gel like the fluorescent toner, the gloss value can be reduced while maintaining the ratio of low molecular weight components needed for low temperature fixability. When the amount of gel is too large, the gloss value of the color toner image is excessively lowered and the amount of diffuse reflection components is increased, resulting in insufficient chroma.

Colorant

As the colorant, those having a small absorption in a wavelength range of 800 nm or higher are preferable. Specific examples of such colorants include, but are not limited to, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, dioxane violet, Anthraquinone Violet, Chrome Green, zinc green, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, perylene black, perinone black, and mixtures thereof. Each of these materials can be used alone or in combination with others.

When the color toner is used as a process color toner, the following colorants are preferably used for each of black, cyan, magenta, and yellow toners.

For black toner, perylene black and perynone black are preferable. For cyan toner, C.I. Pigment Blue 15:3 is preferable. For magenta toner, C.I. Pigment Red 122, C.I. Pigment Red 269, and C.I. Pigment Red 81:4 are preferable. For yellow toner, C.I. Pigment Yellow 74, C.I. Pigment Yellow 155, C.I. Pigment Yellow 180, and C.I. Pigment Yellow 185 are preferable. Each of these colorants can be used alone or in combination with others.

The content of the colorant is preferably from 3% to 12% by mass, more preferably from 5% to 10% by mass, based on the total mass of the color toner of each color, although it depends on the coloring power of each colorant. When the content is 3% by mass or more, coloring power of the toner is sufficient, so that the amount of deposited toner will not be increased and waste of resources is prevented. When the content is 12% by mass or less, chargeability of the toner is not greatly affected, so that it will not become difficult to stably maintain the amount of toner charge.

The color toner according to an embodiment of the present invention has a weight average molecular weight (Mw) of from 4,000 to 15,000, preferably from 7,000 to 10,000. When the weight average molecular weight is 4,000 or less, the glass transition temperature of the toner lowers, storage stability of the toner deteriorates, and the toner aggregates in a storage environment. In addition, viscoelasticity becomes too low at high temperatures and the hot offset resistance deteriorates. When the weight average molecular weight is larger than 15,000, viscoelasticity increases and ductility, low-temperature fixability, and gloss value deteriorate.

Properties of Fluorescent Toner and Color Toner

A toner image formed by the fluorescent toner according to an embodiment of the present invention has a lower gloss value compared to a general full-color electrophotographic image or offset printed matter.

The 60-degree gloss value Gf of the solid image of the fluorescent toner is in a range of from 10 to 25. When the 60-degree gloss value Gf of the solid image of the fluorescent toner is less than 10, the amount of diffuse reflection components of the fluorescent toner image increases, so that saturation of the fluorescence wavelength lowers. When the 60-degree gloss value Gf of the solid image of the fluorescent toner is larger than 25, the amount of specular reflection components of the fluorescent toner image excessively increases and the intensity of the fluorescence wavelength relatively decreases, particularly in an environment with a high illuminance, resulting in deterioration of fluorescence visibility.

The 60-degree gloss value Gn of the solid image of the color toner is preferably in a range of from 25 to 50, more preferably from 30 to 45. When the gloss value is within the above numerical range, the color toner image has a gloss value equivalent to that of a general offset printing image.

The difference (Gn−Gf) between the 60-degree gloss value Gn of the solid image of the color toner and the 60-degree gloss value Gf of the solid image of the fluorescent toner is in a range of from 10 to 28, preferably from 10 to 20. As the difference between the 60-degree gloss value of the solid image of the fluorescent toner and the 60-degree gloss value of the solid image of the color toner becomes larger, the fluorescent toner image becomes more conspicuously visually recognizable.

The fixing conditions for preparing the solid image can be set by an image forming apparatus using the toner set according to an embodiment of the present invention. The image forming method in the image forming apparatus may be variable so long as a method capable of forming the solid image satisfying the above described conditions is available.

The gloss value of the solid image of each of the fluorescent toner and the color toner can be adjusted by, for example, adjusting the gel fraction in the binder resin or the weight average molecular weight of the binder resin. The greater the gel fraction in the binder resin, the lower the gloss value. The closer the gel fraction to 0, the higher the gloss value. In a case in which the binder resin contains no gel, the greater the weight average molecular weight of the binder resin, the lower the gloss value. In addition, the smaller the weight average molecular weight, the higher the gloss value.

When the binder resin comprises a resin having an acid value, the gloss value can be adjusted by adding a metal salt having 3 or more valences thereto. As the acid value of the binder resin and the added amount of the metal salt increase, the gloss value is likely to become lower. As the acid value of the binder resin and the added amount of the metal salt decrease, the gloss value is likely to become higher.

Preferably, the weight average molecular weight Mwf of the fluorescent toner is from 10,000 to 50,000. More preferably, Mwf is larger than the weight average molecular weight Mwn of the binder resin of the color toner. When the weight average molecular weight Mwf of the binder resin of the fluorescent toner is larger than the weight average molecular weight Mwn of the binder resin of the color toner, the resulting fluorescent image is highly visually recognizable and unlikely to be influenced by specular reflection light.

The weight average molecular weight can be determined from a molecular weight distribution of THF-soluble matter that is measured with a GPC (gel permeation chromatography) measuring instrument GPC-150C (manufactured by Waters Corporation).

For example, the weight average molecular weight can be measured using columns (SHODEX KF 801 to 807 manufactured by Showa Denko K.K.) as follows.

The columns are stabilized in a heat chamber at 40° C. A solvent tetrahydrofuran (THF) is let to flow in the columns at that temperature at a flow rate of 1 mL/min. Next, 0.05 g of a sample is thoroughly dissolved in 5 g of THF and thereafter filtered with a pretreatment filter (for example, a chromatographic disk having a pore size of 0.45 μm (manufactured by KURABO INDUSTRIES LTD.)), so that a THF solution of the sample having a sample concentration of from 0.05% to 0.6% by mass is prepared. The THF solution of the sample thus prepared in an amount of from 50 to 200 μl is injected in the measuring instrument.

The ratio (Mw/Mn) of the weight average molecular weight (Mw) to the number average molecular weight (Mn) of the fluorescent toner is preferably 5 or less, more preferably 4 or less.

The weight average molecular weight (Mw) and the number average molecular weight (Mn) are determined by comparing the molecular weight distribution of the fluorescent toner with a calibration curve that has been compiled with several types of monodisperse polystyrene standard samples. Specifically, the calibration curve shows the relation between the logarithmic values of molecular weights and the number of counts.

The polystyrene standard samples include, for example, those having molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$, respectively (available from Pressure Chemical Company or Tosoh Corporation). Preferably, the calibration curve is prepared using at least 10 standard polystyrene samples. As the detector, a refractive index (RI) detector is used.

Particle Diameter of Toner

The fluorescent toner and the color toner preferably have a weight average particle diameter of from 4 to 9 μm, more preferably from 5 to 7 μm.

When the weight average particle diameter is within the above range, fine dots with 600 dpi or more can be reproduced and high quality images can be obtained. This is because the particle diameter of the toner particles is sufficiently smaller than minute dots of a latent image and thus excellent dot reproducibility is exhibited.

When the weight average particle diameter (D4) is 4 μm or more, undesirable phenomena such as reduction of transfer efficiency and deterioration of blade cleaning property can be prevented. When the weight average particle diameter (D4) of the color toner is 9 μm or less, undesirable phenomena can be prevented. For example, disturbance of image, caused when the color toner superimposed on an unfixed image gets in the image, can be prevented. In addition, it will not become difficult to prevent scattering of texts and lines.

The ratio (D4/D1) of the weight average particle diameter (D4) to the number average particle diameter (D1) is preferably from 1.00 to 1.40, more preferably from 1.05 to 1.30. The closer the ratio (D4/D1) to 1.00, the sharper the particle diameter distribution.

With such a toner having a small particle diameter and a narrow particle diameter distribution, since the charge amount distribution is uniform, a high-quality image with less background fog can be obtained. In addition, in an electrostatic transfer method, the transfer rate can be increased.

In a full-color image forming method for forming a multicolor image by superimposing toner images of different colors, compared to a monochrome image forming method for forming an image with only black toner without superimposing toner images of different colors, the amount of toner deposited on paper is larger. That is, since the amount of toner to be developed, transferred, and fixed is increased, the above-described undesirable phenomena that deteriorate image quality, such as reduction of transfer efficiency, deterioration of blade cleaning property, scattering of texts and lines, and background fog, are likely to occur. Thus, the weight average particle diameter (D4) and the ratio (D4/D1) of the weight average particle diameter (D4) to the number average particle diameter (D1) are properly controlled.

The particle size distribution of toner particles can be measured using an apparatus for measuring the particle size distribution of toner particles by the Coulter principle. Examples of such an apparatus include, but are not limited to, COULTER COUNTER TA-II and COULTER MULTISIZER II (both manufactured by Beckman Coulter Inc.).

Specific measuring procedure is as follows.

First, 0.1 to 5 ml of a surfactant (e.g., an alkylbenzene sulfonate), as a dispersant, is added to 100 to 150 ml of an electrolyte solution. Here, the electrolyte solution is an about 1% NaCl aqueous solution prepared with the first grade sodium chloride. As the electrolyte solution, for example, ISOTON-II (available from Beckman Coulter, Inc.) can be used.

Further, 2 to 20 mg of a sample was added thereto. The electrolyte in which the sample is suspended is subjected to a dispersion treatment using an ultrasonic disperser for about 1 to 3 minutes and then to the measurement of the weight and number of toner particles using the above-described instrument equipped with a 100-μm aperture to calculate weight and number distributions. The weight average particle diameter (D4) and number average particle diameter (D1) of the sample can be calculated from the weight and number distributions obtained above.

Thirteen channels with the following ranges are used for the measurement: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm; 8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 Thus, particles having a particle diameter of 2.00 or more and less than 40.30 μm are to be measured.

It is generally known that the loss tangent (tan δ) of toner for electrophotographic development clearly correlates with the gloss value of an image formed of the toner. As tan δ increases, ductility of toner is increased at the time of fixing and substrate hiding property is enhanced, so that a high gloss image is obtained.

Preferably, the loss tangent (tan δf) of the fluorescent toner at 100° to 140° C. is in a range of from 1.0 to 2.0, more preferably from 1.0 to 1.5. Here, a state in which the loss tangent (tan δf) of the fluorescent toner at 100° C. to 140° C. is in a range of from 1.0 to 2.0 refers to a state in which the maximum value of the loss tangent (tan δf) of the fluorescent toner at 100° C. to 140° C. is in that range.

Preferably, the loss tangent (tan δn) of the color toner at 100° to 140° C. is in a range of from 1.5 to 3.0. When the loss tangent (tan δn) of the color toner at 100° C. to 140° C. is within the above numerical range, insufficient chroma and deterioration of hot offset resistance, caused due to small ductility of the color toner at the time of fixing, can be prevented.

Here, a state in which the loss tangent (tan δn) of the color toner at 100° C. to 140° C. is in a range of from 1.5 to 3.0 refers to a state in which the maximum value of the loss tangent (tan δn) of the color toner at 100° C. to 140° C. is in a range of from 1.5 to 3.0.

Preferably, the ratio (tan δn/tan δf) of the loss tangent (tan δn) of the color toner at 100° C. to 140° C. to the loss tangent (tan δf) of the fluorescent toner at 100° C. to 140° C. is greater than 1 and not greater than 3.

The loss tangent (tan δ) of toner for electrophotographic development is represented by the ratio (G"/G') of the loss elastic modulus (G") to the storage elastic modulus (G') that can be measured by viscoelasticity measurement. For example, the loss elastic modulus (G") and the storage elastic modulus (G') can be measured by the following method. First, 0.8 g of the fluorescent toner or color toner is molded using a die having a diameter of 20 mm at a pressure of 30 MPa. The molded toner is subjected to a measurement of loss elastic modulus (G"), storage elastic modulus (G'), and loss tangent (tan δ) using an instrument ADVANCED RHEOMETRIC EXPANSION SYSTEM (manufactured by TA Instruments) equipped with a parallel cone having a diameter of 20 mm under a frequency of 1.0 Hz, a temperature rising rate of 2.0° C./min, and a strain of 0.1% (under automatic strain control in which the allowable minimum stress is 1.0 g/cm, allowable maximum stress is 500 g/cm, maximum applied strain is 200%, and strain adjustment is 200%). GAP is set within a range such that FORCE becomes 0 to 100 gm after the sample is set.

Preferably, both the fluorescent toner and the color toner have a storage elastic modulus (G') of from $1.0\times10^3$ to $1.0\times10^6$ Pa. Preferably, the storage elastic modulus (G') of the fluorescent toner is higher than the storage elastic modulus (G') of the color toner when measured at the same temperature. The loss elastic modulus (G") transits so as not to impair the relationship with the loss tangent (tan δ).

Toner Production Method

The toners of the toner set according to an embodiment of the present invention may be produced by conventionally known methods such as melt-kneading-pulverization methods and polymerization methods. The fluorescent toner and the color toner may be produced by either the same production method or different production methods. For example, it is possible that the fluorescent toner is produced by a melt-kneading-pulverization method and the color toner is produced by a polymerization method.

Melt-Kneading-Pulverization Method

The melt-kneading-pulverization method includes the processes of (1) melt-kneading at least the binder resin, the colorant, and the release agent, (2) pulverizing/classifying the melt-kneaded toner composition, and (3) externally adding fine inorganic particles. It is preferable that fine powder produced in the pulverizing/classifying process (2) is reused as a raw material in the process (1) for saving cost.

Examples of kneaders used for the kneading include, but are not limited to, closed kneaders, single-screw or twin-screw extruders, and open-roll kneaders. Specific examples of the kneaders include, but are not limited to, KRC KNEADER (from Kurimoto, Ltd.); BUSS CO-KNEADER (from Buss AG); TWIN SCREW COMPOUNDER TEM (from Toshiba Machine Co., Ltd.); TWIN SCREW EXTRUDER TEX (from The Japan Steel Works, Ltd.); TWIN SCREW EXTRUDER PCM (from Ikegai Co., Ltd.); THREE ROLL MILL, MIXING ROLL MILL, and KNEADER (from Inoue Mfg., Inc.); KNEADEX (from Nippon Coke & Engineering Company, Limited); MS TYPE DISPERSION MIXER and KNEADER-RUDER (from Moriyama), and BANBURY MIXER (from Kobe Steel, Ltd.).

Specific examples of pulverizers include, but are not limited to, COUNTER JET MILL, MICRON JET, and INOMIZER (from Hosokawa Micron Corporation); IDS-TYPE MILL and PJM JET MILL (from Nippon Pneumatic Mfg. Co., Ltd.); CROSS JET MILL (from Kurimoto, Ltd.); NSE-ULMAX (from Nisso Engineering Co., Ltd.); SK JET-O-MILL (from Seishin Enterprise Co., Ltd.); KRYPTRON (from Kawasaki Heavy Industries, Ltd.); TURBO MILL (from Freund-Turbo Corporation); and SUPER ROATER (from Nisshin Engineering Inc.).

Specific examples of classifiers include, but are not limited to, CLASSIEL, MICRON CLASSIFIER, and SPEDIC CLASSIFIER (from Seishin Enterprise Co., Ltd.); TURBO CLASSIFIER (from Nisshin Engineering Inc.); MICRON SEPARATOR, TURBOPLEX ATP, and TSP SEPARATOR (from Hosokawa Micron Corporation); ELBOW JET (from Nittetsu Mining Co., Ltd.); DISPERSION SEPARATOR (from Nippon Pneumatic Mfg. Co., Ltd.); and YM MICRO CUT (from Yaskawa & Co., Ltd.).

Specific examples of sieving devices for sieving coarse particles include, but are not limited to, ULTRASONIC (manufactured by Koei Sangyo Co., Ltd.); RESONASIEVE and GYRO-SIFTER (manufactured by Tokuju Corporation); VIBRASONIC SYSTEM (manufactured by DALTON CORPORATION); SONICLEAN (manufactured by SINTOKOGIO, LTD.); TURBO SCREENER (manufactured by FREUND-TURBO CORPORATION); MICRO SIFTER (manufactured by MAKINO MFG. CO., LTD.); and circular vibration sieves.

Polymerization Method

Examples of the polymerization method include conventionally known methods. The polymerization method may be conducted by the following procedure. First, the colorant, the binder resin, and the release agent are dispersed in an organic solvent to prepare a toner material liquid (oil phase). Preferably, a polyester prepolymer (A) having an isocyanate group is added to the toner material liquid and allowed to react during granulation so as to form a urea-modified polyester resin in the toner.

Next, the toner material liquid is emulsified in an aqueous medium in the presence of a surfactant and fine resin particles.

The aqueous medium comprises an aqueous solvent. The aqueous solvent may comprise water alone or an organic solvent such as an alcohol.

The used amount of the aqueous solvent is preferably from 50 to 2,000 parts by mass, more preferably from 100 to 1,000 parts by mass, based on 100 parts by mass of the toner material liquid.

The fine resin particles are not particularly limited as long as they are capable of forming an aqueous dispersion thereof, and can be appropriately selected according to the purpose. Examples thereof include, but are not limited to, vinyl resins, polyurethane resins, epoxy resins, and polyester resins.

After the toner material liquid is emulsified (dispersed) in the aqueous medium, the emulsion (i.e., reactant) is subjected to removal of the organic solvent and subsequent washing and drying to obtain mother toner particles.

The fluorescent toner and the color toner each can be used as a one-component developer or a two-component developer.

In a case in which the toner according to an embodiment of the present invention is used as a two-component developer, the toner is mixed with a magnetic carrier. The content of the toner to the carrier in the developer is preferably from 3 to 12 parts by mass based on 100 parts by mass of the carrier.

Examples of the magnetic carrier include conventionally known materials such as iron powder, ferrite powder, magnetite powder, and magnetic resin carriers, each having a particle diameter of about 20 to 200 μm, but are not limited thereto.

Such magnetic carriers may be coated. Specific examples of coating materials for coating the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins.

The coating material may contain a conductive powder. Specific examples of the conductive powder include, but are not limited to, metal powder, carbon black, titanium oxide, tin oxide, and zinc oxide. Preferably, the conductive powder has an average particle diameter of 1 μm or less. When the average particle diameter is 1 μm or less, control of electric resistance will not become difficult.

Image Forming Apparatus and Image Forming Method

An image forming apparatus according to an embodiment of the present invention includes: an electrostatic latent image bearer; an electrostatic latent image forming device configured to form an electrostatic latent image on the electrostatic latent image bearer; a developing device containing the toner set according to an embodiment of the present invention, configured to develop the electrostatic latent image into a visible image (toner image) with the toner set; a transfer device configured to transfer the visible image (toner image) onto a recording medium; and a fixing device configured to fix the transferred image on the recording medium. The image forming apparatus may further include other devices as necessary.

An image forming method according to an embodiment of the present invention includes the processes of: forming an electrostatic latent image on an electrostatic latent image bearer; developing the electrostatic latent image into a visible image (toner image) with the toner set according to an embodiment of the present invention; transferring the visible image (toner image) onto a recording medium; and fixing the transferred image on the recording medium. The image forming method may further include other processes as necessary.

The image forming method according to an embodiment of the present invention can be suitably conducted by the image recording apparatus according to an embodiment of the present invention.

In the image forming method and the image forming apparatus, the 60-degree gloss value Gf of the solid image of the fluorescent toner image is in a range of from 10 to 25. In the image forming method and the image forming apparatus, the difference (Gn−Gf) between the 60-degree gloss value Gn of the solid image of the color toner and the 60-degree gloss value Gf of the solid image of the fluorescent toner is in a range of from 10 to 28, preferably from 10 to 20.

In the image forming method and the image forming apparatus, preferably, the loss tangent (tan δf) of the fluorescent toner at 100° to 140° C. is in a range of from 1.0 to 2.0, more preferably from 1.0 to 1.5. In the image forming method and the image forming apparatus, the loss tangent (tan δn) of the color toner is preferably in a range of from 1.5 to 3.0. Furthermore, preferably, the ratio (tan δn/tan δf)

of the loss tangent (tan δn) of the color toner to the loss tangent (tan δf) of the fluorescent toner is greater than 1 and not greater than 3.

On the recording medium, it is preferable that the color toner image is formed closer to the recording medium than the fluorescent toner image. The color toner image can be formed closer to the recording medium than the fluorescent toner image by, for example, forming the fluorescent toner image after the color toner image is formed on the recording medium.

The number of color toners used for forming the color toner image is not particularly limited and can be appropriately selected according to the purpose. In the case of using a plurality of color toners, either a plurality of toner images may be formed at the same time or single color toner images may be repeatedly formed and superimposed on each other. Repeatedly forming single color toner images and superimposing them on each other is more preferred. In forming the color toner image, the order of forming each single color toner image is not particularly limited.

The deposition amount of the fluorescent toner in the fluorescent toner image is preferably from 0.30 to 0.45 $mg/cm^2$, more preferably from 0.35 to 0.40 $mg/cm^2$. When the deposition amount of the fluorescent toner is 0.30 $mg/cm^2$ or more, the substrate hiding rate of the image is sufficient and a reliable image can be obtained.

Electrostatic Latent Image Bearer

The electrostatic latent image bearer (hereinafter may be referred to as "electrophotographic photoconductor", "photoconductor", or "image bearer") is not limited in material, shape, structure, and size, and can be appropriately selected from known materials. The shape of the image bearer may be, for example, a drum-like shape or a belt-like shape. The material of the image bearer may comprise, for example, inorganic photoconductors such as amorphous silicon and selenium, and organic photoconductors (OPC) such as polysilane and phthalopolymethine.

Electrostatic Latent Image Forming Process and Electrostatic Latent Image Forming Device The electrostatic latent image forming process is a process in which an electrostatic latent image is formed on an electrostatic latent image bearer. The formation of the electrostatic latent image can be conducted by, for example, uniformly charging a surface of the electrostatic latent image bearer and irradiating the surface with light containing image information by the electrostatic latent image forming device.

The electrostatic latent image forming device may include at least a charger to uniformly charge a surface of the electrostatic latent image bearer and an irradiator to irradiate the surface of the electrostatic latent image bearer with light containing image information.

The charging can be conducted by, for example, applying a voltage to a surface of the electrostatic latent image bearer by the charger.

Specific examples of the charger include, but are not limited to, contact chargers equipped with conductive or semiconductive roller, brush, film, or rubber blade and non-contact chargers employing corona discharge such as corotron and scorotron.

Preferably, the charger is disposed in or out of contact with the electrostatic latent image bearer, and configured to charge the surface of the electrostatic latent image bearer by applying a direct-current voltage and an alternating-current voltage superimposed on one another thereto.

Preferably, the charger is a charging roller disposed close to but out of contact with the electrostatic latent image bearer via a gap tape, and configured to charge the surface of the electrostatic latent image bearer by applying a direct-current voltage and an alternating-current voltage superimposed on one another thereto.

The irradiation can be conducted by, for example, irradiating the surface of the electrostatic latent image bearer with light containing image information by the irradiator.

Specific examples of the irradiator include, but are not limited to, various irradiators of radiation optical system type, rod lens array type, laser optical type, and liquid crystal shutter optical type.

The irradiation can also be conducted by irradiating the back surface of the electrostatic latent image bearer with light containing image information.

Developing Process and Developing Device

The developing process is a process in which the electrostatic latent image is developed into a toner image with the toner set.

The formation of the toner image can be conducted by, for example, developing the electrostatic latent image with the toner set by the developing device.

Preferably, the developing device stores the toners of the toner set and is configured to apply the toners to the electrostatic latent image either by contact with or out of contact with the electrostatic latent image. More preferably, the developing device is equipped with a container containing the toners.

The developing device may be either a monochrome developing device or a multicolor developing device. Preferably, the developing device includes an agitator that frictionally agitates and charges the toners of the toner set (hereinafter simply "toner") and a rotatable magnet roller.

In the developing device, toner particles and carrier particles are mixed and agitated. The toner particles are charged by friction and retained on the surface of the rotating magnet roller, thus forming magnetic brush. The magnet roller is disposed proximity to the electrostatic latent image bearer (photoconductor), so that a part of the toner particles composing the magnetic brush formed on the surface of the magnet roller are moved to the surface of the electrostatic latent image bearer (photoconductor) by electric attractive force. As a result, the electrostatic latent image is developed with the toner particles and a toner image is formed with the toner particles on the surface of the electrostatic latent image bearer (photoconductor).

The toner image includes a fluorescent toner image formed by the fluorescent toner and a color toner image formed by the color toner.

The colors constituting the color toner may include, for example, a set of four colors including black (Bk), cyan (C), magenta (M), and yellow (Y), a set of three colors including cyan (C), magenta (M), and yellow (Y), or a single color of black (Bk). Among these, the set of four colors is preferable in that it can be mounted on a general electrophotographic image forming apparatus using four colors.

Fixing Process and Fixing Device

The fixing process is a process in which the visible image transferred onto the recording medium is fixed thereon. The fixing process may be conducted every time each color developer is transferred onto the recording medium. Alternatively, the fixing process may be conducted at once after all color developers are superimposed on one another on the recording medium.

The fixing device has no limit so long as it can fix the transferred visible image onto the recording medium. Preferably, the fixing device includes a heat-pressure member. Specific examples of the heat-pressure member include, but are not limited to, a combination of a heat roller and a pressure roller; and a combination of a heat roller, a pressure roller, and an endless belt.

Preferably, the fixing device includes a heater equipped with a heat generator, a film in contact with the heater, and a pressurizer pressed against the heater via the film, and is configured to allow a recording medium having an unfixed image thereon to pass through between the film and the pressurizer, so that the unfixed image is fixed on the recording medium by application of heat. The heating temperature of the heat-pressure member is preferably from 80 to 200° C.

The fixing pressure is preferably form 10 to 40 N/cm$^2$, and more preferably from 12 to 20 N/cm$^2$. The nip time is preferably from 20 to 60 msec, and more preferably from 40 to 60 msec. However, since the hardness and surface condition of the fixing member also vary, specific conditions can not be limited. It is possible to vary gloss value under specific fixing conditions due to at least differences in thermal properties of the toner.

The fixing device may be used together with or replaced with an optical fixer according to the purpose.

Other Processes and Other Devices

The other processes may include, for example, a neutralization process, a cleaning process, a recycle process, and a control process.

The other devices may include, for example, a neutralizer, a cleaner, a recycler, and a controller.

The neutralization process is a process in which a neutralization bias is applied to the electrostatic latent image bearer to neutralize the electrostatic latent image bearer, and is preferably conducted by a neutralizer.

The neutralizer is not particularly limited so long as it can apply a neutralization bias to the electrostatic latent image bearer, and can be appropriately selected from known neutralizers. For example, a neutralization lamp is preferable.

The cleaning process is a process in which residual toner particles remaining on the electrostatic latent image bearer are removed, and is preferably conducted by a cleaner.

The cleaner is not particularly limited so long as it can remove residual toner particles remaining on the electrostatic latent image bearer, and can be appropriately selected from known cleaners. For example, magnetic brush cleaner, electrostatic brush cleaner, magnetic roller cleaner, blade cleaner, brush cleaner, and web cleaner are preferable.

The recycle process is a process in which the toner particles removed in the cleaning process are recycled for the developing device, and is preferably conducted by a recycler. The recycler is not particularly limited. Specific examples of the recycler include, but are not limited to, a conveyor.

The control process is a process in which the above-described processes are controlled, and is preferably conducted by a controller.

The controller is not particularly limited so long as it can control the above-described processes. Specific examples of the controller include, but are not limited to, a sequencer and a computer.

Details of the image forming method and the image forming apparatus are described below with reference to the drawings. FIG. 1 is a schematic diagram illustrating an image forming apparatus according to an embodiment of the present invention. Image data sent to an image processor (hereinafter "IPU") 14 generates image signals of five colors including Iv (fluorescence), Y (yellow), M (magenta), C (cyan), and Bk (black).

Next, the image processor 14 transmits the image signals of Iv, Y, M, C, Bk to a writing device 15. The writing device 15 modulates and scans five laser beams for Iv, Y, M, C and Bk, so that chargers 51, 52, 53, 54, and 55 respectively charge photoconductor drums 21, 22, 23, 24, and 25 and form respective electrostatic latent images thereon. Here, as an example, the first photoconductor drum 21 corresponds to Iv, the second photoconductor drum 22 corresponds to Y, the third photoconductor drum 23 corresponds to M, the fourth photoconductor drum 24 corresponds to C, and the fifth photoconductor drum 25 corresponds to Bk.

Next, developing devices 31, 32, 33, 34, and 35 form toner images of respective colors on the photoconductor drums 21, 22, 23, 24, and 25. A sheet feeder 16 feeds a transfer sheet onto a transfer belt 70. Transfer chargers 61, 62, 63, 64, and 65 sequentially transfer each toner image onto the photoconductor drums 21, 22, 23, 24, and 25, respectively.

After completion of the transfer process, the transfer sheet is conveyed to a fixing device 80. The fixing device 80 fixes the transferred toner image on the transfer sheet.

After completion of the transfer process, residual toner particles remaining on the photoconductor drums 21, 22, 23, 24, and 25 are removed by respective cleaners 41, 42, 43, 44, and 45.

Figure 2:
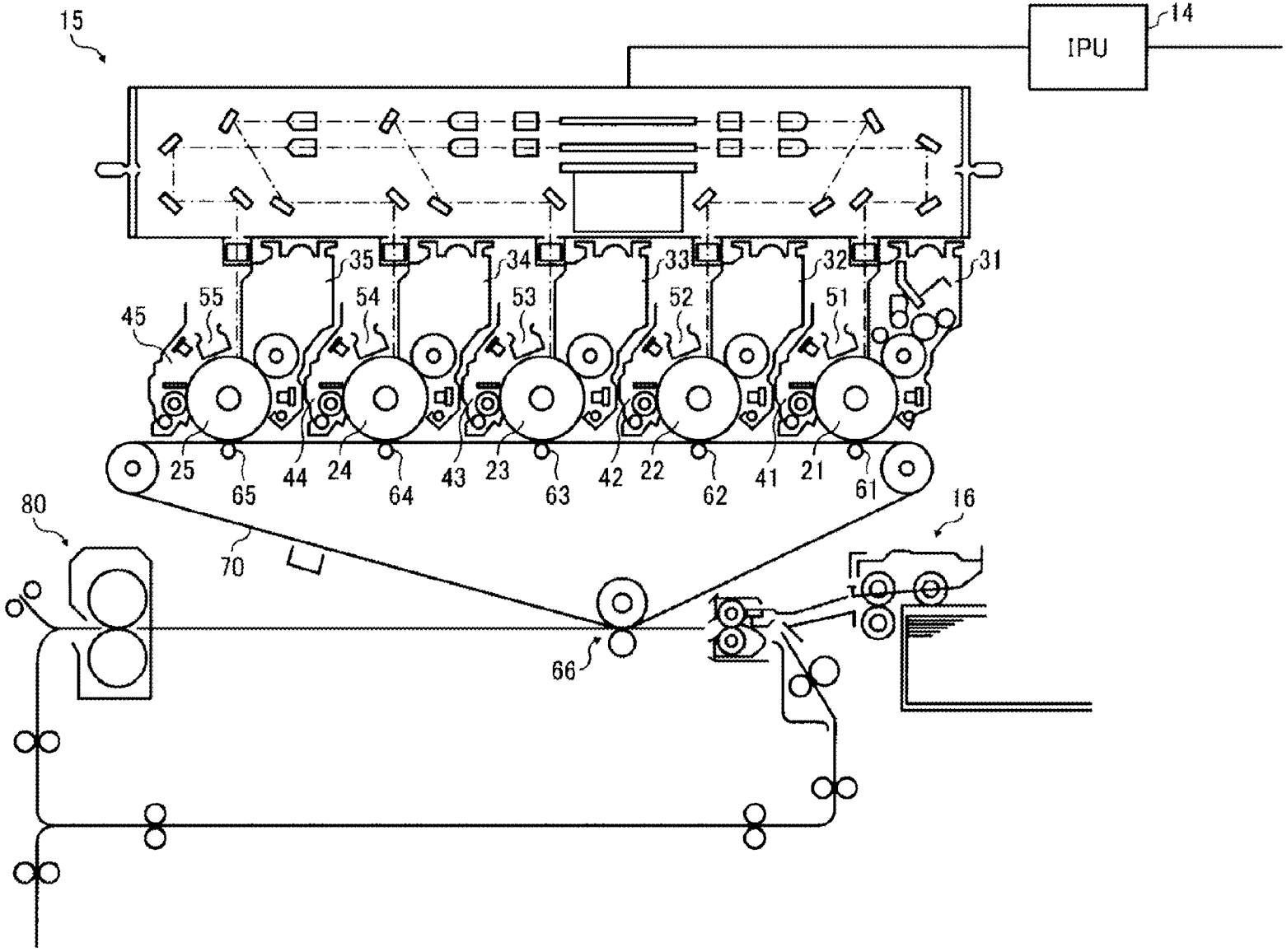
FIG. 2 is a schematic view of an image forming apparatus according to an embodiment of the present invention.
Figure 3:
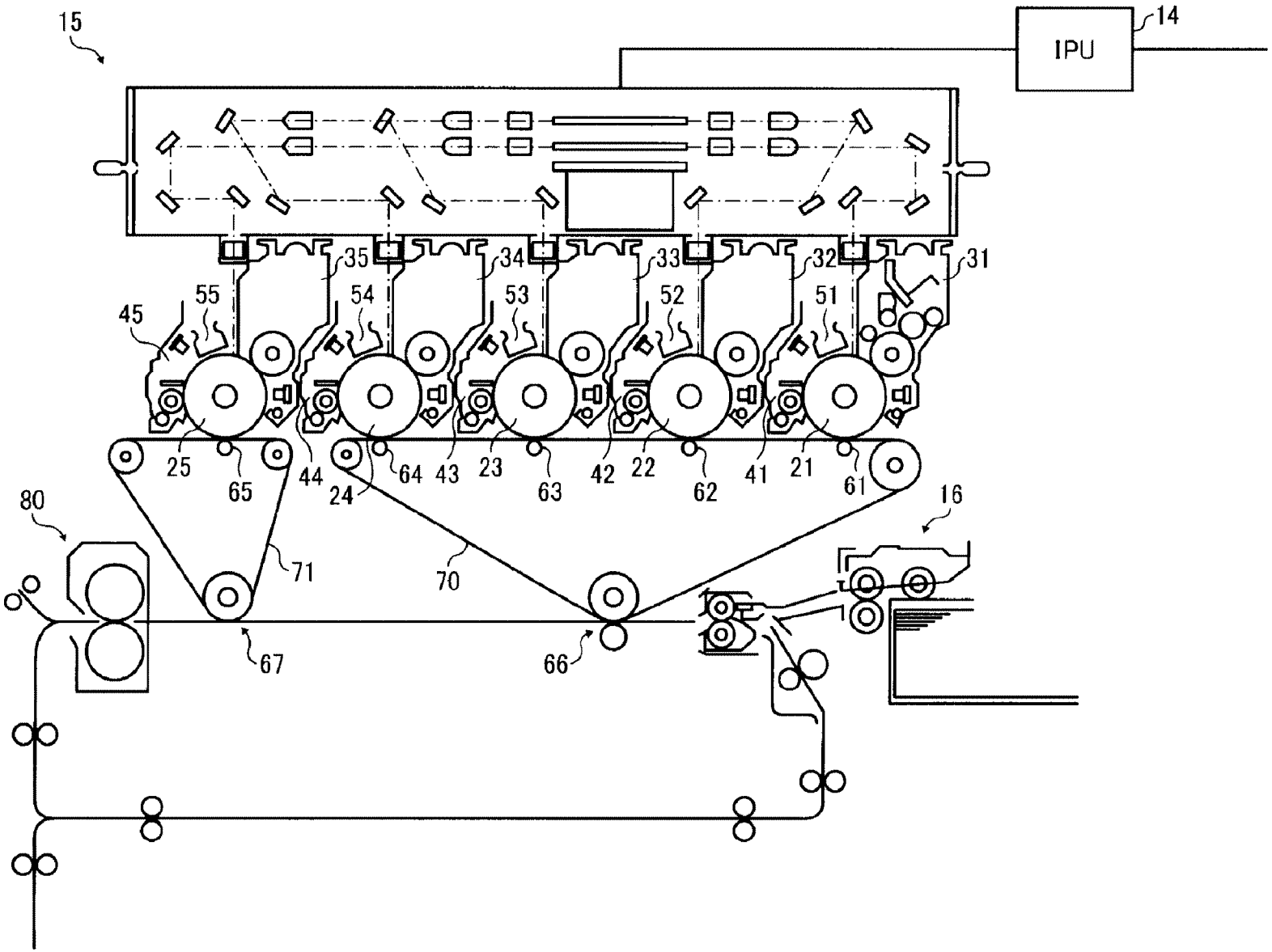
FIG. 3 is a schematic view of an image forming apparatus according to an embodiment of the present invention.

In an image forming apparatus according to an embodiment of the present invention illustrated in FIG. 2, toner images formed on the photoconductor drums 21, 22, 23, 24, and 25 in the same manner as in FIG. 1 are temporarily transferred onto the transfer belt 70, further transferred onto a transfer sheet by a secondary transfer device 66, and fixed on the transfer sheet by the fixing device 80. When the fluorescent toner is formed into a thick layer on the transfer belt, a separate transfer belt 71 and a separate secondary transfer device 67 for the fluorescent toner may be provided as illustrated in FIG. 3, since the fluorescent toner layer is so thick that secondary transfer thereof is difficult.

The toner set according to an embodiment of the present invention may be contained in a process cartridge detachably attached to an image forming apparatus body that integrally supports a photoconductor and at least one of an electrostatic latent image forming device, a developing device, and a cleaner.

Figure 4:
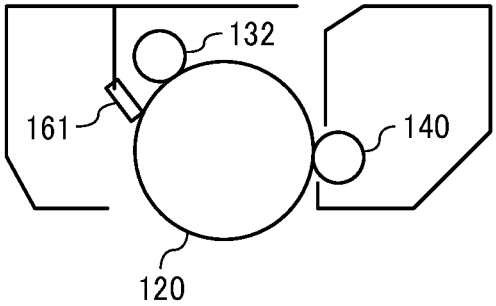
FIG. 4 is a schematic view of a process cartridge according to an embodiment of the present invention.

FIG. 4 is a schematic diagram of a process cartridge according to an embodiment of the present invention that contains the toner set according to an embodiment of the present invention.

Referring to FIG. 4, the process cartridge includes a photoconductor 120, an electrostatic latent image forming device 132, a developing device 140, and a cleaner 161.

In the present embodiment, multiple constituent elements including the photoconductor 120, the electrostatic latent image forming device 132, the developing device 140, and the cleaner 161 are integrally combined to provide a process cartridge. The process cartridge is configured to be detachably attached to an image forming apparatus main body such as a copier and a printer.

The operation of the image forming apparatus equipped the process cartridge containing the toner set according to an embodiment of the present invention is described below.

The photoconductor is driven to rotate at a predetermined circumferential speed. During rotation of the photoconductor, a circumferential surface of the photoconductor is uniformly charged to a predetermined positive or negative potential by the electrostatic latent image forming device, and then irradiated with light emitted from an irradiator by slit exposure or laser beam scanning exposure, so that electrostatic latent images are sequentially formed on the circumferential surface of the photoconductor. The electrostatic latent images thus formed are subsequently developed into toner images by the developing device. The toner images are sequentially transferred onto a transfer material fed from a sheet feeder to between the photoconductor and the transfer device in synchronization with rotation of the photoconductor. The transfer material having the transferred image thereon is separated from the surface of the photoconductor and introduced to the fixing device so that the image is fixed. The transfer material having the fixed image thereon is printed out the apparatus as a copy. After the image transfer, the surface of the photoconductor is cleaned by removing residual toner particles by the cleaner and further neutralized to be repeatedly used for image formation.

EXAMPLES

Further understanding can be obtained by reference to certain specific examples which are provided herein for the purpose of illustration only and are not intended to be limiting. In the following descriptions, "parts" represents "parts by mass" unless otherwise specified.

Production of Fluorescent Toner 1

Polyester 1 (EXL-101 manufactured by Sanyo Chemical Industries, Ltd., having a weight average molecular weight Mw of 6,500 and an acid value of 10 mgKOH/g): 65 parts Polyester 2 (RN-290SF manufactured by Kao Corporation, having a weight average molecular weight Mw of 87,000 and acid value of 28 mgKOH/g): 25 parts Wax dispersant (EXD-001 manufactured by Sanyo Chemical Industries, Ltd.): 5 parts Monoester wax 1 (LW-13 manufactured by Sanyo Chemical Industries, Ltd., having a melting point mp of 70.5° C.): 5 parts Charge controlling agent 1 (TN-105 manufactured by Hodogaya Chemical Co., Ltd., salicylic acid derivative zirconium salt A): 1.0 part Solvent Red 49 (ROB-B manufactured by Orient Chemical Industries Co., Ltd.): 1.5 parts The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at 100° C. to 130° C.

The kneaded product was cooled to room temperature and pulverized into coarse particles having a diameter of from 200 to 300 μm by a ROTOPLEX.

The coarse particles were further pulverized into fine particles having a weight average particle diameter of 6.4±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.8±0.2 μm and the ratio of weight average particle diameter to number average particle diameter became 1.20 or less. Thus, a mother toner 1 was prepared.

Subsequently, 100 parts of the mother toner 1 were mixed with additives including 0.70 parts of a fumed silica (ZD-30ST manufactured by Tokuyama Corporation), 1.0 part of a fumed silica (UFP-35HH manufactured by Denka Company Limited), and 0.6 parts of a titanium dioxide (MT-150 AFM manufactured by Tayca Corporation) by a HENSCHEL MIXER, thus preparing a fluorescent toner 1.

Production of Fluorescent Toner 2

A fluorescent toner 2 was produced in the same manner as the fluorescent toner 1 except for changing the amounts of the polyester 1, the polyester 2, and the charge controlling agent 1 to 55 parts, 35 parts, and 0.5 parts, respectively.

Production of Fluorescent Toner 3

A fluorescent toner 3 was produced in the same manner as the fluorescent toner 1 except for changing the amounts of the polyester 1 and the polyester 2 to 75 parts and 15 parts, respectively.

Production of Fluorescent Toner 4

Polyester 1 (EXL-101 manufactured by Sanyo Chemical Industries, Ltd., having a weight average molecular weight Mw of 6,500 and an acid value of 10 mgKOH/g): 65 parts Polyester 2 (RN-290SF manufactured by Kao Corporation, having a weight average molecular weight Mw of 87,000 and acid value of 28 mgKOH/g): 25 parts Wax dispersant (EXD-001 manufactured by Sanyo Chemical Industries, Ltd.): 5 parts Monoester wax 1 (LW-13 manufactured by Sanyo Chemical Industries, Ltd., having a melting point mp of 70.5° C.): 5 parts Charge controlling agent 1 (TN-105 manufactured by Hodogaya Chemical Co., Ltd., salicylic acid derivative zirconium salt A): 1.0 part Pigment Yellow 101 (LUMOGEN YELLOW S 0795, manufactured by BASF): 5.0 parts The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at 100° C. to 130° C.

The kneaded product was cooled to room temperature and pulverized into coarse particles having a diameter of from 200 to 300 μm by a ROTOPLEX.

The coarse particles were further pulverized into fine particles having a weight average particle diameter of 6.4±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.8±0.2 μm and the ratio of weight average particle diameter to number average particle diameter became 1.20 or less. Thus, a mother toner 4 was prepared.

Subsequently, 100 parts of the mother toner 4 were mixed with additives including 0.70 parts of a fumed silica (ZD-30ST manufactured by Tokuyama Corporation), 1.0 part of a fumed silica (UFP-35HH manufactured by Denka Company Limited), and 0.6 parts of a titanium dioxide (MT-150 AFM manufactured by Tayca Corporation) by a HENSCHEL MIXER, thus preparing a fluorescent toner 4.

Production of Fluorescent Toner 5

A fluorescent toner 5 was produced in the same manner as the fluorescent toner 4 except for changing the amounts of the polyester 1, the polyester 2, and the charge controlling agent 1 to 55 parts, 35 parts, and 0.5 parts, respectively.

Production of Fluorescent Toner 6

A fluorescent toner 6 was produced in the same manner as the fluorescent toner 4 except for changing the amounts of the polyester 1 and the polyester 2 to 75 parts and 15 parts, respectively.

Production of Fluorescent Toner 7

A fluorescent toner 7 was produced in the same manner as the fluorescent toner 3 except for changing the amount of the charge controlling agent 1 to 0 part.

Production of Fluorescent Toner 8

A fluorescent toner 8 was produced in the same manner as the fluorescent toner 1 except for changing the amounts of the polyester 1, the polyester 2, and the charge controlling agent 1 to 50 parts, 40 parts, and 1.0 part, respectively.

Production of Fluorescent Toner 9

Polyester 1 (EXL-101 manufactured by Sanyo Chemical Industries, Ltd., having a weight average molecular weight Mw of 6,500 and an acid value of 10 mgKOH/g): 80 parts Polyester 3 (RN-300SF manufactured by Kao Corporation, having a weight average molecular weight Mw of 14,000 and acid value of 4 mgKOH/g): 10 parts Wax dispersant (EXD-001 manufactured by Sanyo Chemical Industries, Ltd.): 5 parts Monoester wax 1 (LW-13 manufactured by Sanyo Chemical Industries, Ltd., having a melting point mp of 70.5° C.): 5 parts Charge controlling agent 1 (TN-105 manufactured by Hodogaya Chemical Co., Ltd., salicylic acid derivative zirconium salt A): 1.0 part Solvent Red 49 (ROB-B manufactured by Orient Chemical Industries Co., Ltd.): 1.5 parts The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at 100° C. to 130° C.

The kneaded product was cooled to room temperature and pulverized into coarse particles having a diameter of from 200 to 300 μm by a ROTOPLEX.

The coarse particles were further pulverized into fine particles having a weight average particle diameter of 6.4±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.8±0.2 μm and the ratio of weight average particle diameter to number average particle diameter became 1.20 or less. Thus, a mother toner 9 was prepared.

Subsequently, 100 parts of the mother toner 9 were mixed with additives including 0.70 parts of a fumed silica (ZD-30ST manufactured by Tokuyama Corporation), 1.0 part of a fumed silica (UFP-35HH manufactured by Denka Company Limited), and 0.6 parts of a titanium dioxide (MT-150 AFM manufactured by Tayca Corporation) by a HENSCHEL MIXER, thus preparing a fluorescent toner 9.

Production of Color Toner Set 1

Polyester 1 (EXL-101 manufactured by Sanyo Chemical Industries, Ltd., having a weight average molecular weight Mw of 6,500 and an acid value of 10 mgKOH/g): 75 parts Polyester 2 (RN-290SF manufactured by Kao Corporation, having a weight average molecular weight Mw of 87,000 and acid value of 28 mgKOH/g): 15 parts Wax dispersant (EXD-001 manufactured by Sanyo Chemical Industries, Ltd.): 5 parts Monoester wax 1 (LW-13 manufactured by Sanyo Chemical Industries, Ltd., having a melting point mp of 70.5° C.): 5 parts Charge controlling agent 1 (TN-105 manufactured by Hodogaya Chemical Co., Ltd., salicylic acid derivative zirconium salt A): 0.5 parts Colorants listed below were each added to the toner raw materials listed above so that toners of each color were produced.

Black toner: Carbon black (MITSUBISHI CARBON BLACK #44 manufactured by Mitsubishi Chemical Corporation) 7 parts Cyan toner: Pigment Blue 15:3 (Lionol Blue FG 7351 manufactured by Toyo Ink Co., Ltd.) 5 parts Magenta toner: Pigment Red 269 (1022 manufactured by DIC Corporation) 7 parts Yellow toner: Pigment Yellow 185 (D1155 manufactured by BASF SE) 7 parts The toner raw materials listed above and each of the colorants were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at 100° C. to 130° C.

The kneaded product was cooled to room temperature and pulverized into coarse particles having a diameter of from 200 to 300 μm by a ROTOPLEX.

The coarse particles were further pulverized into fine particles having a weight average particle diameter of 6.4±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.8±0.2 μm and the ratio of weight average particle diameter to number average particle diameter became 1.20 or less. Thus, respective mother toners for black toner, cyan toner, magenta toner, and yellow toner were prepared.

Subsequently, 100 parts of each of the mother toners were mixed with additives including 0.70 parts of a fumed silica (ZD-30ST manufactured by Tokuyama Corporation), 1.0 part of a fumed silica (UFP-35HH manufactured by Denka Company Limited), and 0.6 parts of a titanium dioxide (MT-150 AFM manufactured by Tayca Corporation) by a HENSCHEL MIXER, thus preparing a color toner set 1.

Production of Color Toner Set 2

A color toner set 2 was produced in the same manner as the color toner set 1 except for changing the amounts of the polyester 1 and the polyester 2 to 80 parts and 10 parts, respectively.

Measurement of Loss Tangent (Tan δ)

The loss tangent (tan δ) of the above-prepared fluorescent toners and color toners were measured in the following manner. First, 0.8 g of each toner was molded using a die having a diameter of 20 mm at a pressure of 30 MPa. Next, the molded toner was subjected to a measurement of loss elastic modulus (G"), storage elastic modulus (G'), and loss tangent (tan δ) within a range of from 100° C. to 140° C. using an instrument ADVANCED RHEOMETRIC EXPANSION SYSTEM (manufactured by TA Instruments) equipped with a parallel cone having a diameter of 20 mm under a frequency of 1.0 Hz, a temperature rising rate of 2.0° C./min, and a strain of 0.1% (under automatic strain control in which the allowable minimum stress is 1.0 g/cm, allowable maximum stress is 500 g/cm, maximum applied strain is 200%, and strain adjustment is 200%). GAP was set within a range such that FORCE became 0 to 100 gm after the sample was set.

The loss tangent (tan δn) of the color toner set is the average value of the loss tangent of the color toners included therein.

Production of Two-Component Developer

Preparation of Carrier

Silicone resin (Organo straight silicone): 100 parts

Toluene: 100 parts γ-(2-Aminoethyl) aminopropyl trimethoxysilane: 5 parts

Carbon black: 10 parts

The above materials were dispersed by a homomixer for 20 minutes to prepare a coating layer forming liquid. Manganese (Mn) ferrite particles having a weight average particle diameter of 35 μm, serving as core materials, were coated with the coating layer forming liquid using a fluidized bed coating device while controlling the temperature inside the fluidized bed to 70° C. The dried coating layer on the surface of the core material had an average film thickness of 0.20 μm. The core material having the coating layer was calcined in an electric furnace at 180° C. for 2 hours. Thus, a carrier was prepared.

Preparation of Developer (Two-Component Developer)

Each of the fluorescent toners 1 to 9 and the color toner set (including black, cyan, magenta, yellow toners) 1 to 2 was uniformly mixed with the carrier by a TURBULA MIXER (available from Willy A. Bachofen AG) at a revolution of 48 rpm for 5 minutes to be charged. Thus, fluorescent toner developers 1 to 9 and the color toner developer sets 1 and 2 were each prepared.

The mixing ratio of the toner to the carrier was 7% by mass, which was equal to the initial toner concentration in the developer in the test machine.

Examples 1 to 4 and Comparative Examples 1 to 5

In a production printer (RICOH PRO C7110 manufactured by Ricoh Company, Ltd.) containing five color toners, i.e., yellow toner, magenta toner, cyan toner, black toner, and special color toner, the above-prepared fluorescent toner 1 was set in the special color toner mounting portion and the developer contained in the special color developing unit was replaced with the fluorescent toner developer 1. Thus, a toner set 0-1 was prepared.

Toner sets 0-2 to 0-9 were produced in the same manner as the toner set 0-1 except for replacing the fluorescent toner 1 and the fluorescent toner developer 1 with the respective fluorescent toners 2 to 9 and the respective fluorescent toner developers 2 to 9.

As a paper sheet, COATED GLOSSY PAPER (135 g/m$^2$ manufactured by Mondi Group) was used. A solid patch of 5 cm×5 cm was output to the paper sheet using each color toner of the color toner set, and the deposition amount and gloss value of each color toner were measured as follows. Measurement results are presented in Table 1. Also, the deposition amount and gloss value of each fluorescent toner were measured in the same manner. Measurement results are presented in Tables 1 to 4.

In the EXAMPLES, the fixing conditions were set as follows.

The fixing pressure was preferably set to 10 to 40 N/cm$^2$, more preferably to 12 to 20 N/cm$^2$.

The nip time was preferably set to 20 to 60 msec, more preferably to 40 to 60 msec.

Deposition Amount

After removing the fixing unit from the RICOH PRO C7110, an unfixed solid patch of 5 cm×5 cm was output thereby. The solid patch was cut out with scissors to prepare a cutout piece. The mass of the cutout piece was measured with a precision balance. After the toner in the solid patch portion (unfixed image portion) was blown off with an air gun, the mass of the cutout piece was measured again. The toner deposition amount was calculated from the mass of the cutout piece before and after the toner has been blown off by the air gun according to the following formula. Measurement results are presented in Tables 1 to 4. The deposition amount of each of the color toner sets 0 to 2 is presented by the average value of the deposition amount of each color toner.

Toner Deposition Amount (mg/cm$^2$)=((Mass of Cutout Piece with Solid Patch)−(Mass of Cutout Piece after Blowing of Toner))/25

Gloss Value

A fixed 5 cm×5 cm solid patch outputted from the RICOH PRO C7110 was measured using a gloss meter (VGS-1D manufactured by Nippon Denshoku Industries Co., Ltd.) at four positions. The average value of the measurement results at the four positions was calculated and determined as a gloss value. Measurement results are presented in Tables 1 to 4. The gloss value of each of the color toner sets 0 to 2 is presented by the average value of the gloss value of each color toner.

Next, evaluation of printed matter was conducted as follows. Evaluation results are presented in Table 2.

Eye Attractiveness

One object of using fluorescent colors in an image is to improve eye attractiveness (a power of color that attracts human eye) of at least a part of the image. The eye attractiveness is further improved when there is a gloss difference between a fluorescent color image and other color image.

In this evaluation, eye attractiveness of fluorescent color portions on printed matter containing "a color image including illustrations, texts, and bar codes", printed with each toner set containing each fluorescent toners 1 to 9, was evaluated under a fluorescent lamp with a luminance of 500 lux (Lx) (assumed to be a normal office environment).

The evaluation was conducted by arbitrarily selected 30 men and women between the ages of 20 and 50. When they felt that the fluorescent color image had a special color unlike other color image, the fluorescent color image was judged to be acceptable. When they did not feel any special difference between the fluorescent color image and other color image, the fluorescent color image was judged to be unacceptable.

When 25 or more people out of 30 people judged that the fluorescent color image was acceptable, the fluorescent color image was determined to be good. When less than 25 people judged that the fluorescent color image was acceptable, the fluorescent color image was determined to be poor.

Visibility

When fluorescent color is used for images, it may be difficult to distinguish the fluorescent color when the images are looked under high illuminance environment. It is considered that this phenomenon depends on the surface property of the fluorescent image. Specifically, it is considered that it becomes difficult to distinguish the fluorescent color when diffuse reflection on the surface is large or specular reflection on the surface is large.

In this evaluation, visibility of the printed matter containing "a color image including illustrations, texts, and bar codes" printed with each toner set containing each fluorescent toners 1 to 9, the same as that used for the evaluation of eye attractiveness, was evaluated under a fluorescent lamp with a luminance of 2,000 Lx.

The evaluation was conducted by arbitrarily selected 30 men and women between the ages of 20 and 50. When they felt that the fluorescent color was recognizable from any angle, the fluorescent color image was judged to be acceptable. When they felt that the fluorescent color was difficult to recognize depending on the angle, or the fluorescent color image was difficult to recognize from any angle, the fluorescent color image was judged to be unacceptable.

When 25 or more people out of 30 people judged that the fluorescent color image was acceptable, the fluorescent color image was determined to be good. When less than 25 people judged that the fluorescent color image was acceptable, the fluorescent color image was determined to be poor.

Mixed Color Balance

One object of using fluorescent colors in an image is to improve reproducibility of light (pale) colors. Fluorescent pink is often used for an insertion color for expressing a good skin color.

If the gloss value of an image using the fluorescent toner as an insertion color is greatly different as compared with that of other color images, it will result in an image causing a feeling of strangeness.

Mixed color balance for fluorescent color used as an insertion color in printed matter containing "a color image including a photograph of a female face having makeup with pink cosmetics", printed with each toner set containing each fluorescent toners 1 to 9, was evaluated under a fluorescent lamp with a luminance of 500 lux (Lx) (assumed to be a normal office environment).

The evaluation was conducted by arbitrarily selected 30 men and women between the ages of 20 and 50. When they had no feeling of strangeness with the image, the image was judged to be acceptable. When they had no feeling of strangeness with the fluorescent color alone but had a feeling of strangeness with the fluorescent color image alone, the image was judged to be unacceptable. When they had a feeling of strangeness with the whole image, the image was also judged to be unacceptable.

When 25 or more people out of 30 people judged that the image was acceptable, the image was determined to be good. When 15 to 24 people judged that the image was acceptable, the image was determined to be average. When less than 14 people judged that the image was acceptable, the image was determined to be poor.

TABLE 1

| | Deposition Amount ($mg/cm^2$) | Gloss Value | Loss Tangent (tanδn) |
|---|---|---|---|
| Color Toner Set 0 | 0.35 | 32 | 1.6 |
| Color Toner Set 1 | 0.40 | 34 | 2.1 |
| Color Toner Set 2 | 0.40 | 44 | 2.7 |
| Fluorescent Toners 1 to 9 | 0.40 | | |

TABLE 2

| | Fluorescent Toner | | | | | | Evaluation Results | | | |
|---|---|---|---|---|---|---|---|---|---|---|
| | Toner Set No. | No. | 60-Degree Gloss Value Gf | tanδf | Gloss Value Difference Gn − Gf | tanδ Ratio (tanδn/tanδf) | Eye Attractiveness | Visibility | Mixed Color Balance | Overall Judgment |
| Example 1 | 0-1 | 1 | 18 | 1.1 | 14 | 1.5 | Good | Good | Good | Good |
| Example 2 | 0-2 | 2 | 12 | 1.0 | 20 | 1.6 | Good | Good | Good | Good |
| Comparative Example 1 | 0-3 | 3 | 25 | 1.5 | 7 | 1.1 | Poor | Good | Good | Poor |
| Example 3 | 0-4 | 4 | 16 | 1.2 | 16 | 1.3 | Good | Good | Good | Good |
| Example 4 | 0-5 | 5 | 10 | 1.0 | 22 | 1.6 | Good | Good | Good | Good |
| Comparative Example 2 | 0-6 | 6 | 23 | 1.8 | 9 | 0.9 | Poor | Good | Good | Poor |
| Comparative Example 3 | 0-7 | 7 | 35 | 2.5 | −3 | 0.6 | Poor | Poor | Good | Poor |
| Comparative Example 4 | 0-8 | 8 | 3 | 0.4 | 29 | 4.0 | Poor | Poor | Poor | Poor |
| Comparative Example 5 | 0-9 | 9 | 85 | 10.0 | −53 | 0.2 | Good | Poor | Poor | Poor |

In Table 2, the "overall judgment" is "poor" in a case in which at least one of evaluation results of "eye attractiveness", "visibility", and "mixed color balance" is "poor". In all the other cases, the "overall judgment" is "good". The same applies to Tables 3 and 4.

Examples 11 to 15 and Comparative Examples 11 to 14

A toner set 1-1 was prepared in the same manner as the toner set 0-1 except for replacing the black, cyan, magenta, and yellow developers with developers using toners of the toner set 1.

Toner sets 1-2 to 1-9 were produced in the same manner as the toner set 1-1 except for replacing the fluorescent toner 1 and the fluorescent toner developer 1 with the respective fluorescent toners 2 to 9 and the respective fluorescent toner developers 2 to 9.

The toner sets 1-1 to 1-9 were evaluated in the same manner as the toner set 0-1. Evaluation results are presented in Table 3.

TABLE 3

| | Fluorescent Toner | | | | | | Evaluation Results | | | |
|---|---|---|---|---|---|---|---|---|---|---|
| | Toner Set No. | No. | 60-Degree Gloss Value Gf | tanδf | Gloss Value Difference Gn − Gf | tanδ Ratio (tanδn/tanδf) | Eye Attractiveness | Visibility | Mixed Color Balance | Overall Judgment |
| Example 11 | 1-1 | 1 | 18 | 1.1 | 16 | 1.9 | Good | Good | Good | Good |
| Example 12 | 1-2 | 2 | 12 | 1.0 | 22 | 2.1 | Good | Good | Average | Good |
| Comparative Example 11 | 1-3 | 3 | 25 | 1.5 | 9 | 1.4 | Poor | Good | Good | Poor |
| Example 13 | 1-4 | 4 | 16 | 1.2 | 18 | 1.8 | Good | Good | Good | Good |
| Example 14 | 1-5 | 5 | 10 | 1.0 | 24 | 2.1 | Good | Good | Average | Good |
| Example 15 | 1-6 | 6 | 23 | 1.8 | 11 | 1.2 | Good | Good | Good | Good |
| Comparative Example 12 | 1-7 | 7 | 35 | 2.5 | −1 | 0.8 | Poor | Poor | Good | Poor |
| Comparative Example 13 | 1-8 | 8 | 3 | 0.4 | 31 | 5.3 | Poor | Poor | Poor | Poor |
| Comparative Example 14 | 1-9 | 9 | 85 | 10.0 | −51 | 0.2 | Good | Poor | Poor | Poor |

Examples 21 to 24 and Comparative Examples 21 to 25

A toner set 2-1 was prepared in the same manner as the toner set 0-1 except for replacing the black, cyan, magenta, and yellow developers with developers using toners of the toner set 2.

Toner sets 2-2 to 2-9 were produced in the same manner as the toner set 2-1 except for replacing the fluorescent toner 1 and the fluorescent toner developer 1 with the respective fluorescent toners 2 to 9 and the respective fluorescent toner developers 2 to 9.

The toner sets 2-1 to 2-9 were evaluated in the same manner as the toner set 0-1. Evaluation results are presented in Table 4.

TABLE 4

| | Fluorescent Toner | | | | | | Evaluation Results | | | |
|---|---|---|---|---|---|---|---|---|---|---|
| | Toner Set No. | No. | 60-Degree Gloss Value Gf | tanδf | Gloss Value Difference Gn − Gf | tanδ Ratio (tanδn/tanδf) | Eye Attractiveness | Visibility | Mixed Color Balance | Overall Judgment |
| Example 21 | 2-1 | 1 | 18 | 1.1 | 26 | 2.5 | Good | Good | Average | Good |
| Comparative Example 21 | 2-2 | 2 | 12 | 1.0 | 32 | 2.7 | Good | Good | Poor | Poor |
| Example 22 | 2-3 | 3 | 25 | 1.5 | 19 | 1.8 | Good | Good | Good | Good |
| Example 23 | 2-4 | 4 | 16 | 1.2 | 28 | 2.3 | Good | Good | Average | Good |
| Comparative Example 22 | 2-5 | 5 | 10 | 1.0 | 34 | 2.7 | Good | Good | Poor | Poor |
| Example 24 | 2-6 | 6 | 23 | 1.8 | 21 | 1.5 | Good | Good | Good | Good |
| Comparative Example 23 | 2-7 | 7 | 35 | 2.5 | 9 | 1.1 | Poor | Poor | Good | Poor |
| Comparative Example 24 | 2-8 | 8 | 3 | 0.4 | 41 | 6.8 | Poor | Poor | Poor | Poor |
| Comparative Example 25 | 2-9 | 9 | 85 | 10.0 | −41 | 0.3 | Good | Poor | Poor | Poor |

In accordance with some embodiments of the present invention, a toner set and an image forming apparatus are provided that are capable of expressing designs with high fluorescent color visibility and high eye attractiveness.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner set for use in an image forming apparatus, comprising:

a fluorescent toner comprising a binder resin and a fluorescent agent; and a color toner comprising a binder resin and a colorant, wherein a 60-degree gloss value (Gf) of a solid image of the fluorescent toner is in a range of from 10 to 25, wherein a difference (Gn−Gf) between a 60-degree gloss value (Gn) of a solid image of the color toner and the 60-degree gloss value (Gf) of the solid image of the fluorescent toner is in a range of from 10 to 28, wherein each of the fluorescent toner and the color toner is in a form of a toner particle, wherein each of the 60-degree glass value (Gf) of the solid image of the fluorescent toner and the 60-degree glass value (Gn) of the solid image of the color toner is measured by a gloss meter, and wherein a weight average molecular weight (Mwn) of a binder resin of the color toner is smaller than a weight average molecular weight (Mwf) of a binder resin of the fluorescent toner.

2. The toner set of claim 1, wherein the 60-degree gloss value (Gf) of the solid image of the fluorescent toner is in a range of from 10 to 20.

3. The toner set of claim 1, wherein a loss tangent (tan δf) of the fluorescent toner at 100° C. to 140° C. is in a range of from 1.0 to 2.0, wherein a loss tangent (tan δn) of the color toner at 100° C. to 140° C. is in a range of from 1.5 to 3.0, wherein a ratio (tan δn/tan δf) of the loss tangent (tan δn) of the color toner at 100° C. to 140° C. to the loss tangent (tan δf) of the fluorescent toner at 100° C. to 140° C. is greater than 1 and not greater than 3.

4. The toner set of claim 1, wherein the color toner comprises cyan toner, magenta toner, yellow toner, and black toner.

5. The toner set of claim 1, wherein the fluorescent agent comprises C.I. Pigment Yellow 101.

6. The toner set of claim 1, wherein the 60-degree gloss value (Gn) of the solid image of the color toner is in a range of from 25 to 50.

7. The toner set of claim 1, wherein the 60-degree gloss value (Gn) of the solid image of the color toner is in a range of from 30 to 45.

8. The toner set of claim 1, wherein the weight average molecular weight (Mwf) of the binder resin of the fluorescent toner is from 10,000 to 50,000.

9. An image forming apparatus comprising:

an electrostatic latent image bearer;

an electrostatic latent image forming device configured to form an electrostatic latent image on the electrostatic latent image bearer;

a developing device comprising the toner set of claim 1, configured to develop the electrostatic latent image into a visible image with the toner set;

a transfer device configured to transfer the visible image onto a recording medium; and a fixing device configured to fix the transferred image on the recording medium.

10. An image forming method comprising:

forming an electrostatic latent image on an electrostatic latent image bearer;

developing the electrostatic latent image into a visible image with the toner set of claim 1;

transferring the visible image onto a recording medium; and fixing the transferred image on the recording medium.

* * * * *